United States Patent [19]

Heerlein

[11] 3,949,521

[45] Apr. 13, 1976

[54] WALKING DOLL WITH SITTING CAPABILITY

[75] Inventor: Horst Heerlein, Dorfles, Germany

[73] Assignee: Puppenfabrik Hans Gotz, Rodental, Germany

[22] Filed: Apr. 15, 1974

[21] Appl. No.: 460,973

Related U.S. Application Data

[63] Continuation of Ser. No. 277,561, Aug. 3, 1972, abandoned.

[52] U.S. Cl. ..... 46/247; 46/150

[51] Int. Cl.[2] ..... A63H 29/22

[58] Field of Search ..... 46/150, 247

[56] References Cited

UNITED STATES PATENTS

| | | | |
|---|---|---|---|
| 3,445,960 | 5/1969 | Ryan | 46/150 |
| 3,599,364 | 8/1971 | Garcia | 46/150 |

FOREIGN PATENTS OR APPLICATIONS

| | | | |
|---|---|---|---|
| 20,183 | 8/1904 | United Kingdom | 46/150 |

*Primary Examiner*—F. Barry Shay

*Attorney, Agent, or Firm*—Hane, Baxley & Spiecens

[57] ABSTRACT

There is disclosed a walking toy figure such as a walking doll. The toy figure comprises a hollow trunk on which are suspended a pair of limbs such as legs which are freely pivotal between a standing position in which the legs occupy a substantially vertical position and a step position in which the legs are swung forwardly with reference to the standing position thereof. Drive means such as a miniature electric motor are coupled with the trunk so as to impart to the same lateral pendular movements. As a result of such movements, the weight of the figure is alternately shifted from one leg to the other, thereby causing the legs to swing alternately from the standing position to the step position and back again as the legs are lifted and put down again, thus causing the figure to walk forwardly in a wobbling manner similar to the walking of a toddler.

5 Claims, 3 Drawing Figures

WALKING DOLL WITH SITTING CAPABILITY

This is a continuation of application Ser. No. 277,561 filed Aug. 3, 1972, now abandoned.

The invention relates to a walking toy figure, and particularly to a walking doll so designed that walking of the doll somewhat resembles the walk of a toddler.

BACKGROUND OF THE INVENTION

There are known walking toy figures of the general kind above referred to in which a suitably geared drive mechanism imparts lateral pendular movements to the trunk of the doll or other toy figure. These lateral pendular movements are utilized to cause alternate forward and back swinging of the legs and alternate lifting and putting down of the legs.

Mechanisms for producing the afore-referred to walking of a doll or other toy figure as heretofore known require many components and expensive assembly.

THE INVENTION

It is a broad object of the invention to provide a novel and improved toy figure such as a walking doll of the general kind above referred to which has a mechanism requiring only comparatively few components that can be easily and inexpensively assembled.

SUMMARY OF THE INVENTION

The aforepointed out objects, features and advantages and other objects, features and advantages which will be pointed out hereinafter are obtained by providing within the hollow trunk of the toy figure such as a doll a support for a mechanism producing lateral pendular movements of the trunk and also for pivotally suspending the legs of the doll. The suspension and the structure of the legs are arranged so that when either of the legs is relieved of the weight of the figure, it swings into a position defining an acute angle with reference to the vertical position, and that when the weight of the doll is shifted to a leg in said angular position, the same will be put down on the support surface for the doll and swing back into its vertical position in response to the next pendular movement of the trunk. As it is evident, these alternate leg movements will cause a wobbling walk of the doll or other toy figure.

According to one embodiment of the invention, the drive mechanism comprises a power drive means and a gearing which is coupled via a crank pin with the trunk of the doll to effect the pendular movements of the trunk when the gearing is driven by the drive means. The crank pin is preferably coupled to the trunk by engagement with an elongate slot in the trunk.

The crank pin, when eccentrically rotating with respect to the axis of the gear on which it is mounted, moves the trunk alternately into positions slanted toward the left and the right, whereby the movable limbs of the toy figure such as legs of a doll, are alternately lifted from a surface on which the toy is placed. Since as previously described, the lengthwise axis of a leg is at an angle with respect to the vertical when the weight of the toy is lifted from the leg, this leg will touch the support surface for the doll at a point forward of its vertical position when the weight is again shifted to the leg. Accordingly, the leg is in effect making a forward step. As the aforedescribed swinging movements of the legs are alternately repeated for both legs, the doll or other figure will walk forward step by step.

The walking speed of the doll or other figure depends on the rotary speed of the crank pin as it is this speed which controls the pendular movements of the trunk. As it is now apparent, the walking of the doll or other figure is somewhat wobbly and thus is similar to the walking of a toddler.

The structural components required to achieve the afore-pointed out movements are few and simple. The gearing can be replaced by a belt drive. Such drive, especially if a V-belt is used, has the advantage of causing less noise than a gearing.

The invention also provides that the drive means such as a miniature electric motor are placed in a housing which includes a holder for supporting the gearing and especially the shafts thereof. The support for the housing may further include a holder for the axles from which the movable limbs, such as legs, are suspended. The axles for the legs are stationarily mounted and the movable legs of the figure are rotatably seated thereon.

As previously mentioned, the trunk of the figure is coupled via the crank pin secured to the gearing with the support for the drive means and is also coupled with the means for suspending the movable limbs. The invention also provides that the holder which constitutes part of the support supports a shaft for a pendular movement of the trunk. This shaft may be formed as a one-piece pin which rotatably engages sleeves secured to the trunk.

It has been found to be particularly advantageous when the axle for the pivotal limbs mounts a coupling ring rotatably seated on this axle. The position of this coupling ring on the axle for suspending of the limbs is secured by a lock ring. The movable limbs are fixedly secured to the coupling ring, for instance, by gluing.

The invention further contemplates that the doll or other toy figure, according to the invention, cannot only walk forwardly but can also sit down. Sitting down of the doll requires a movement of the legs through an angle of about 90° with reference to the vertical standing position of the legs. For this purpose, the axle on which the legs are mounted further comprises for each of the legs a coupling disc which by spring action coacts with the respective coupling disc. Moreover, the coupling disc has cam-like protrusions coacting with correspondingly shaped depressions in the coupling disc. Of course, the cam-like protrusions may also be provided on the coupling disc and the coacting depressions on the coupling disc. The springy arrangement of the coupling discs may be obtained by providing between the holder and each coupling disc a loaded coil spring wound about the axle for the limbs.

Furthermore, it has been found to be particularly advantageous to provide a means for selecting the length of the steps to be performed by the legs, as previously described. Such step selecting means comprises a bar extending crosswise of the walking direction of the toy figure and engaging at both ends slots in the coupling discs. As it is evident, the circumference of the circumferential width of these slots will limit the length of the steps as the bar ends slide within the slots and the legs move backward and forward.

BRIEF DESCRIPTION OF THE DRAWING FIGURES

In the accompanying drawing, a preferred embodiment of the invention is shown by way of illustration and not by way of limitation.

DETAILED DESCRIPTION OF THE INVENTION

Figure 1:
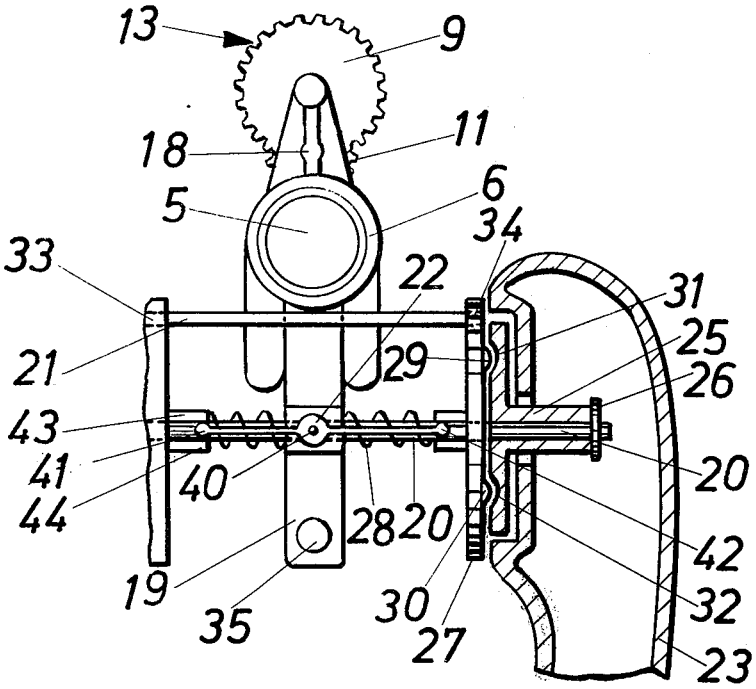
FIG. 1 is an elevational view, partly in section, of the mechanisms for effecting movement and suspension of a movable limb such as a leg.

Referring now to the drawing figures more in detail, the illustrated embodiment of the invention exemplifies a walking doll. Only those components of the doll that are essential for the understanding of the invention are shown. As it is readily apparent, the concept of the invention is not limited to walking dolls but applicable to various other toy figures.

There is shown a trunk composed of two shell halves 1 and 2 made for instance of a suitable plastic. A support assembly 3 is suitably mounted within the trunk. This support assembly mounts a driving assembly which includes a drive motor such as a miniature electric motor 5. This motor is housed at least partly in a casing 6 which constitutes part of support assembly 3. Current is supplied to motor 5 by a battery 7 which is supported on lugs 8 which may be secured to or integral with shell 1.

Figure 2:
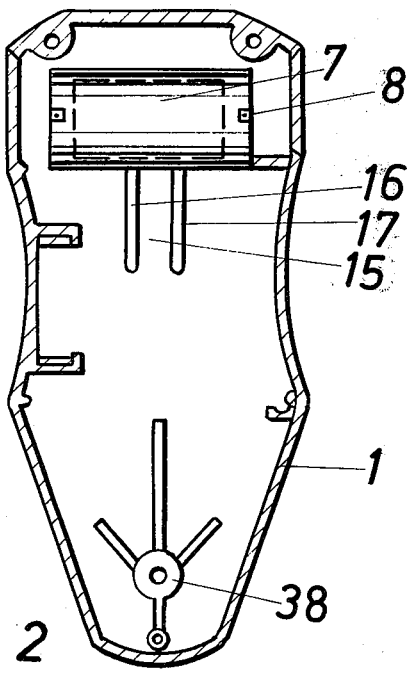
FIG. 2 is a lengthwise section of one-half of the trunk of the toy figure on a reduced scale.
Figure 3:
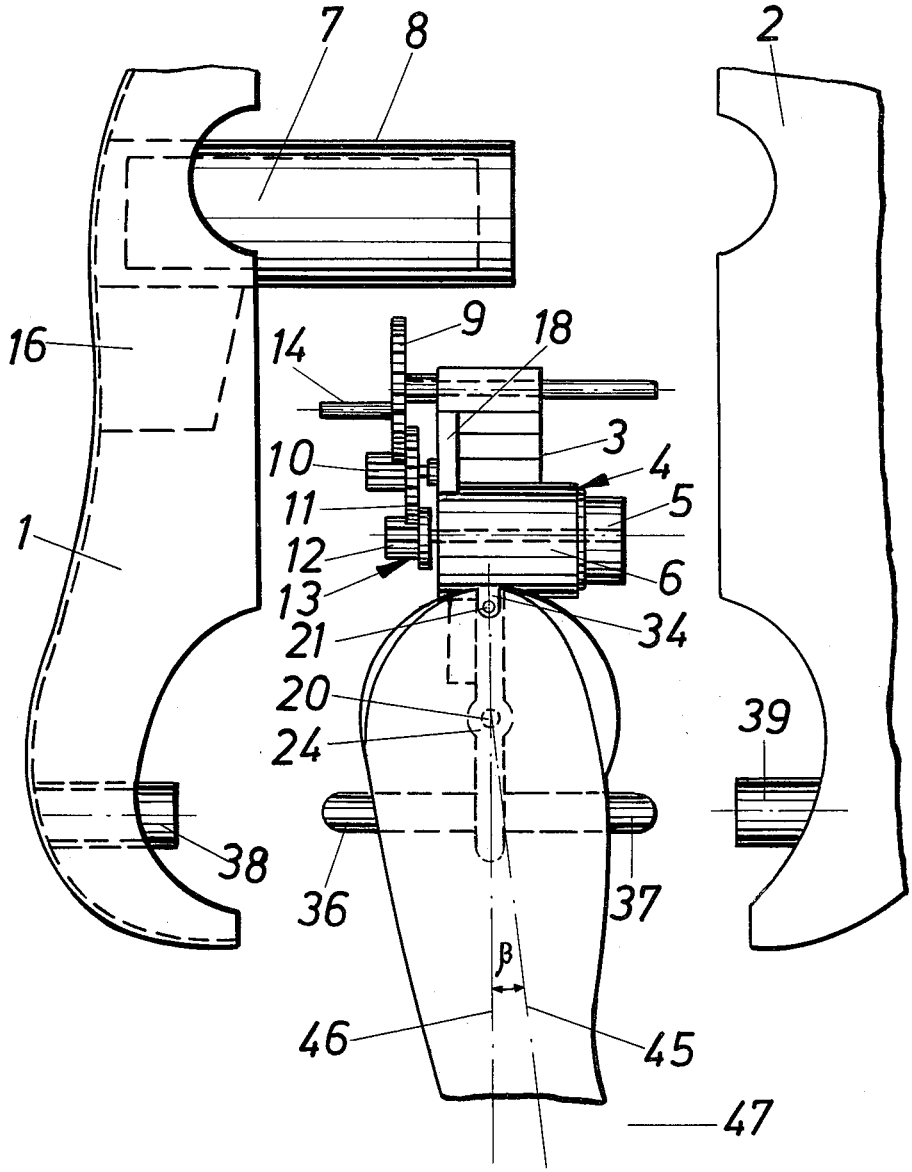
FIG. 3 is an elevational side view of FIG. 1 on an enlarged scale and also diagrammatically illustrating the shell halves forming the trunk

To produce the afore-referred to pendular movements of the trunk, a gearing 13 including gears 9, 10, 11 and 12, is provided. Gear 12, the input gear of the gearing, is seated on the drive shaft of motor 5 and the output gear 9 mounts an eccentrically disposed crank pin 14. This pin engages a slot 15 formed in or on trunk shell 1 by spaced aprt protrusions 16 and 17. As it is apparent, crank pin 14 when rotating about the rotational axis of gear 9 will alternately coact with protrusions 16 and 17, thereby imparting lateral pendular movements to shell 1 and thus also to shell 2 which is joined to shell 1. In other words, the trunk will alternately move to the left and right as shown in FIG. 2.

The shafts for the gears in gearing 13 are journaled in an extension 18 of support assembly 3. This extension is secured to or integral with motor casing 6 on the side thereof facing the head of the doll (not shown). The support assembly 3 is continued on its opposite side by a holder 19 which in turn supports members 20 and 21 for suspending a limb 23 which may be visualized as a leg. Suspension member 20 is in the form of an axle which is seated in a bearing 24 formed in holder 19. Each end of axle 20 mounts a flanged coupling disc 25. These discs are rotatable on axle 20 and have fixedly secured thereto legs 23, for instance, by gluing the legs to the flange of disc 25. To retain the coupling disc 25 in position a lock ring 26 is provided at each end of axle 20. The axle further mounts coupling discs 27, one for each of the legs 23. Each disc 27 is spring biased toward the respective coupling disc by means of a coil spring 28. Each coupling disc has on its side facing the respective coupling disc cam-like protrusions 29 and 30 which are engageable with corresponding depressions 31 and 32 in coupling discs 25. Protrusions 29 and 30, depressions 31 and 32, in conjunction with the spring bias acting upon the coupling discs permit placement of the doll in a sitting position in which the legs 23 define an angle of about 90° with the position occupied by the legs in the standing or vertical position thereof. As it is evident, the springy retention of the coupling discs permits sliding of protrusions 29, 30 out of coacting depressions 31, 32 so that the coupling discs 27 can be displaced slightly in the direction of the lengthwise axis of the doll, that is, along the axle 20. When the legs of the doll are turned back into the standing position, the afore-described functions occur in reverse order, that is, protrusions 29, 30 will again be engaged with depressions 31, 32 and are retained in this position by the pressure exerted upon the lengthwise displaceable coupling discs by the action of springs 27.

A bar or pin 21 also secured to holder 19 is engaged at both its ends with slots 33, 34 in coupling discs 27 whereby the circumferential widths of slots 33, 34 determine the length of the steps.

Holder 19 further mounts a bearing shaft 35 for the trunk. This shaft terminates at both ends in pins 36 and 37 which are journaled in cylindrical sleeves 38 and 39 oppositely disposed on trunk shells 1 and 2, respectively.

Holder 19 may mount a pin or bar 22 supporting a coupling means 40. Coupling means 40 includes arms 41 and 42 extending toward coupling discs 27. Each of these coupling discs mounts spaced apart extensions 43 and 44. The free ends of arms 41 and 42 extend between the respective pair of extensions. These coupling means permit the angular movements of the legs 23 as the same swing due to the pendular movements of the trunk which are more fully explained hereinafter. The coupling means 40 may be omitted if desirable as the length of the steps of the legs is controlled by the circumferential width of slots 33 and 34 in coupling discs 27.

Forward walking of the figure is obtained by disposing the lengthwise axis 45 of legs 23 or other limbs so that these legs when free of the weight of the figure define an angle $\beta$ between this axis and a vertical line 46 intersecting with the suspension axis of the legs and the direction 47 of the walking of the figure. Accordingly, each leg 23 when not under load, will automatically pivot slightly in the walking direction. When now subjected to the weight of the toy, the leg will be put down on a forwardly located point. Repetition of alternately shifting the weight from one leg to the other causing the afore-described swinging movements of the legs due to lateral pendular movements of the trunk will produce the desired walking of the doll or other toy.

While the invention has been described in detail with respect to a certain now preferred example and embodiment of the invention, it will be understood by those skilled in the art, after understanding the invention, that various changes and modifications may be made without departing from the spirit and scope of the invention, and it is intended, therefore, to cover all such changes and modifications in the appended claims.

What is claimed is:

1. A walking doll comprising in combination:

an elongate hollow trunk;

a support member mounted within said trunk;

a bearing member on said support member and journaling said trunk to be pivotal thereabout;

an axle secured to said support member and extending from opposite sides thereof;

a pair of first discs, each rotatably seated on said axle on opposite sides of said support member;

a pair of legs each secured to one side of one of said first discs for angular movement in unison therewith;

a pair of second discs each rotatable and axially slidable on said axle and disposed in juxtaposition to the other side of the respective one of said first discs, each of said second discs having a recess in its periphery;

cooperating coupling means on said first and second discs and on said axle releasably coupling each of said second discs with the respective first coupling disc thereby providing for angular movements of each leg and the first and second coupling disc associated therewith as a leg unit;

a bar secured to said support member extending therefrom on opposite sides, each end of said bar being engaged with one of said peripheral recesses thereby limiting the angular movements of the respective leg unit to the circumferential width of the respective recess; and activating means for effecting alternate pendular movements to the legs secured to said first discs, said activating means including drive means and transmission means coupled to said drive means and having an output member coacting with the trunk so as to impart to the same lateral pendular movements about said bearing means, each of said legs being balanced and correlated so as to assume a position substantially parallel to the lengthwise axis of the trunk when the weight of the doll is supported by it, said position constituting the standing position of the leg and to swing into a position defining an acute angle with the lengthwise axis of the trunk when the leg is relieved of the weight of the doll, said angular position of the leg constituting the step position thereof, successive pivotal movements of each leg from the standing position into the step position and back into the standing position being caused by shifting the weight of the doll to alternate legs thereby effecting walking of the doll;

release of said coupling means freeing said first discs and the legs secured thereto for rotation about said axle independent of said second discs and of the circumferential widths of said peripheral recesses in the second discs thereby permitting turning of the legs into angular positions for sitting of the doll.

2. The walking doll according to claim 1 wherein said coupling means includes the facing sides of each first and each second disc having at least one complementary protrusion and depression, engagement of a protrusion and the respective depression releasably retaining the respective first and second disc in a predetermined angular position relative to each other, rotation of each first disc with the respective leg secured thereto forcing the respective protrusion and depression out of engagement thereby freeing the respective leg for angular movement independent of the circumferential width of the peripheral recess in the respective second coupling disc thereby providing for placement of the legs in the sitting position of the doll.

3. The walking doll according to claim 1 wherein said drive means comprise a rotary drive means, and wherein said transmission means comprise a gear train having an input gear and an output gear, the input gear being coupled to said rotary drive means and the output gear having secured thereto on one of its sides a crank pin extending parallel to the rotational axis of the output gear but spaced apart therefrom, said trunk mounting on an inside wall portion a slot, said crank pin extending into said slot, engagement of the pin with alternate sides of the slot as the output gear is rotated causing said pendular movements of the trunk.

4. The walking doll according to claim 1 wherein said rotary drive means comprise an electric miniature motor and a housing having a bracket mounted on said support member, said housing enclosing said motor and said bracket mounting said gear train.

5. The walking doll according to claim 1 wherein said bearing means comprise two bearing sleeves extending from oppositely disposed internal wall portions of the trunk, and pins extending from said support member on opposite sides thereof, the ends of said pins being rotatably seated in said sleeves.

* * * * *

UNITED STATES PATENT OFFICE

CERTIFICATE OF CORRECTION

Patent No. 3,949,521 Dated April 13, 1976

Inventor(s) Horst Heerlein

It is certified that error appears in the above-identified patent and that said Letters Patent are hereby corrected as shown below:

On the cover sheet insert:

-- [30] Foreign Application Priority Data

Germany P 21 52 690.9 Oct. 22, 1971 --.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*